US005924819A

United States Patent [19]

Breidenbach

[11] Patent Number: 5,924,819

[45] Date of Patent: Jul. 20, 1999

[54] LINKAGE MECHANISM FOR AN EXTENDABLE ASPHALT PAVER SCREED

[75] Inventor: Thomas S. Breidenbach, Maple Grove, Minn.

[73] Assignee: Caterpillar Paving Products, Minneapolis, Minn.

[21] Appl. No.: 09/012,310

[22] Filed: Jan. 23, 1998

[51] Int. Cl.[6] ..... E01C 9/10; E01C 19/00; E01C 19/22; E04G 21/10

[52] U.S. Cl. ..... 404/96; 404/104; 404/118

[58] Field of Search ..... 404/83, 90, 96, 404/101, 104, 118

[56] References Cited

U.S. PATENT DOCUMENTS

| | | | |
|---|---|---|---|
| 3,288,041 | 11/1966 | Layton . | |
| 3,415,173 | 12/1968 | Paul | 404/118 |
| 3,482,494 | 12/1969 | Jennings, Jr. | 404/118 |
| 3,709,116 | 1/1973 | Whitbread et al. | 404/96 |
| 3,992,124 | 11/1976 | Schrader | 404/118 |
| 4,272,213 | 6/1981 | McGovarin | 404/118 |
| 4,345,852 | 8/1982 | Goto et al. | 404/114 |
| 4,379,653 | 4/1983 | Brown | 404/118 |
| 4,502,813 | 3/1985 | Hojberg | 404/102 |
| 4,688,965 | 8/1987 | Smith et al. | 404/75 |
| 4,702,642 | 10/1987 | Musil | 404/118 |
| 4,808,026 | 2/1989 | Clarke, Jr. et al. | 404/90 |
| 4,900,186 | 2/1990 | Swisher, Jr. et al. | 404/105 |
| 5,129,803 | 7/1992 | Nomura et al. | 425/62 |
| 5,203,642 | 4/1993 | Heller et al. | 404/118 |
| 5,215,404 | 6/1993 | Raymond | 404/118 |
| 5,344,254 | 9/1994 | Sartain | 404/104 |
| 5,725,325 | 3/1998 | Schleiter et al. | 404/118 |

*Primary Examiner*—Thomas B. Will
*Assistant Examiner*—Gary S. Hartmann
*Attorney, Agent, or Firm*—Patterson Keough

[57] ABSTRACT

An asphalt paver screed includes a linkage mechanism connecting a main screed and at least one extender screed. The linkage mechanism controls movement of the extender screed relative to the main screed (via a pair of upper and lower frames connecting the extender screed and main screed) along three generally perpendicular axes. The linkage mechanism includes a plurality of links with at least one elongate lateral link extending along a lateral axis generally parallel to a first horizontal axis, at least one elongate fore/aft link extending along a fore/aft axis generally parallel to a second horizontal axis, and at least one selectively length-adjustable link extending along an axis generally parallel to a third vertical axis. The length adjustable link permits selective adjustment of vertical spacing and sloping between the main screed and the extender screed.

8 Claims, 8 Drawing Sheets

42
40
45
46A
47
48A
44
70
62
46B
48B
68
66
72
49

LINKAGE MECHANISM FOR AN EXTENDABLE ASPHALT PAVER SCREED

BACKGROUND OF THE INVENTION

The present invention relates to an asphalt paving screed, and in particular, an extendable asphalt paving screed.

Floating screed pavers are well known in the art and typically include a paving vehicle with a reservoir of asphalt material and a main screed which trails behind the paving vehicle to spread out, level, and compact the asphalt paving material. The main screed is connected to the paving vehicle by pivoted towing arms to permit the screed to "float" over the surface on which asphalt is to be applied.

In order to widen the asphalt paving path, prior art devices have provided extendable screeds which can extend laterally outward from a main screed. Extendable screeds typically include means for selectively sloping the extendible screed relative to the main screed to form a sloped shoulder on the paved surface. North American-type prior art extender screeds accomplish this sloping by rotatably mounting the extender screed relative to the main screed. For example, U.S. Pat. No. 5,230,642 to Heeler, et al. discloses an extendable screed with a means for pivoting the extender screed relative to the main screed.

A common problem plaguing many extendible screeds includes deflection and/or misalignment of the extender screed relative to the main screed due to the force of the asphalt paving material pushing against the front of the extender screed as the main screed and extender screed are pulled along by the paving vehicle. Deflection or misalignment of the extender screed relative to the main screed can result in an uneven, low quality paved road surface.

North American-type prior art extender screed arrangements include extension mechanisms (an assembly to permit an extender screed to extend laterally outward from a main screed) that are not symmetrical as they overlap laterally to permit full retraction of the extender screeds relative to the main screed. This non-symmetrical overlap causes each screed of the pair of extender screeds to have a different deflection characteristic during paving since slightly different framing of the extender screed and extender mechanism framing is required to permit the overlap necessary for full retraction of the extender mechanisms.

While prior art European-type extendible screeds typically are symmetrical, these screeds are bulkier having multiple vertical actuators to control height adjustment and sloping of the extender screeds. The actuators are commonly positioned at opposite ends of the extender screed (e.g. at the inboard end and outboard end). The actuators positioned at the outboard end of the extender screed contribute to undesirable deflection of the extender screeds since the outboard actuators and related structure add weight at a point furthest away from the main screed. In addition, adjusting the slope of the extender screed to cause a slope in the paved surface is cumbersome since the vertical actuators are spaced apart at opposite ends (e.g. inboard and outboard ends) of the extender screed. Moreover, this large spacing between the vertical actuators results in an inability to quickly change the slope of the extender screed, as is more commonly required in North American-type paving projects. Finally, the European-type extender screeds also are commonly linked to the main screed via a pair of upper and lower links arranged on top of the extender screed and extending the entire width of the extender screed. These upper and lower links add weight and bulk to the extender screeds, particularly at the outboard end of the extender screed, thereby further contributing to undesirable deflection of the extender screed relative to the main screed.

Accordingly, prior art extendible asphalt paving screeds can still be improved by further minimizing deflection of the extender screed relative to the main screed during asphalt paving while still permitting quick and precise vertical adjustment and sloping of the extender screed relative to the main screed.

SUMMARY OF THE INVENTION

An asphalt paver screed of the present invention permits selective vertical adjustment and sloping of an extender screed relative to a main screed while minimizing undesirable deflection of the extender screed relative to the main screed. This arrangement achieves a uniform paved road surface with optimal ability to shape the road surface by selectively and reliably manipulating the position of the extender screed relative to the main screed.

The asphalt paver screed of the present invention comprises a main screed and at least one extender screed having an upper frame and a lower frame. A linkage mechanism connects the upper frame to the lower frame and is disposed to maintain the upper frame in a vertically spaced relationship relative to the lower frame. The linkage mechanism includes a plurality of elongate links with each link extending between and connected to the upper frame and the lower frame and arranged along three generally perpendicular axes. The plurality of links are arranged adjacent an inboard end of the extender screed and include: (1) at least one elongate link extending along a lateral axis generally parallel to a first horizontal axis; (2) at least one elongate link extending along a fore/aft axis generally parallel to a second horizontal axis; and (3) a pair of selectively length-adjustable links with each link extending along an axis generally parallel to a third vertical axis.

The upper and lower frames and the linkage mechanism extend only along a portion of the extender screed adjacent the inboard end of the extender screed, thereby minimizing deflection of the extender screed relative to the main screed. Moreover, the positioning of both links of the pair of length-adjustable links of the linkage mechanism at the inboard end of the extender screed enables quick selective sloping of the extender screed while, in combination with the other links, minimizes deflection of the extender screed. This quick sloping feature is particularly advantageous during frequent implementation of a desired slow change in the height of the extender screed alternatively with frequent implementation of the slope change. Neither European-type extender screeds nor North American-type extender screeds have this capability in a linkage mechanism that provides improved deflections characteristics for an extender screed.

DETAILED DESCRIPTION OF PREFERRED EMBODIMENTS

Figure 1:
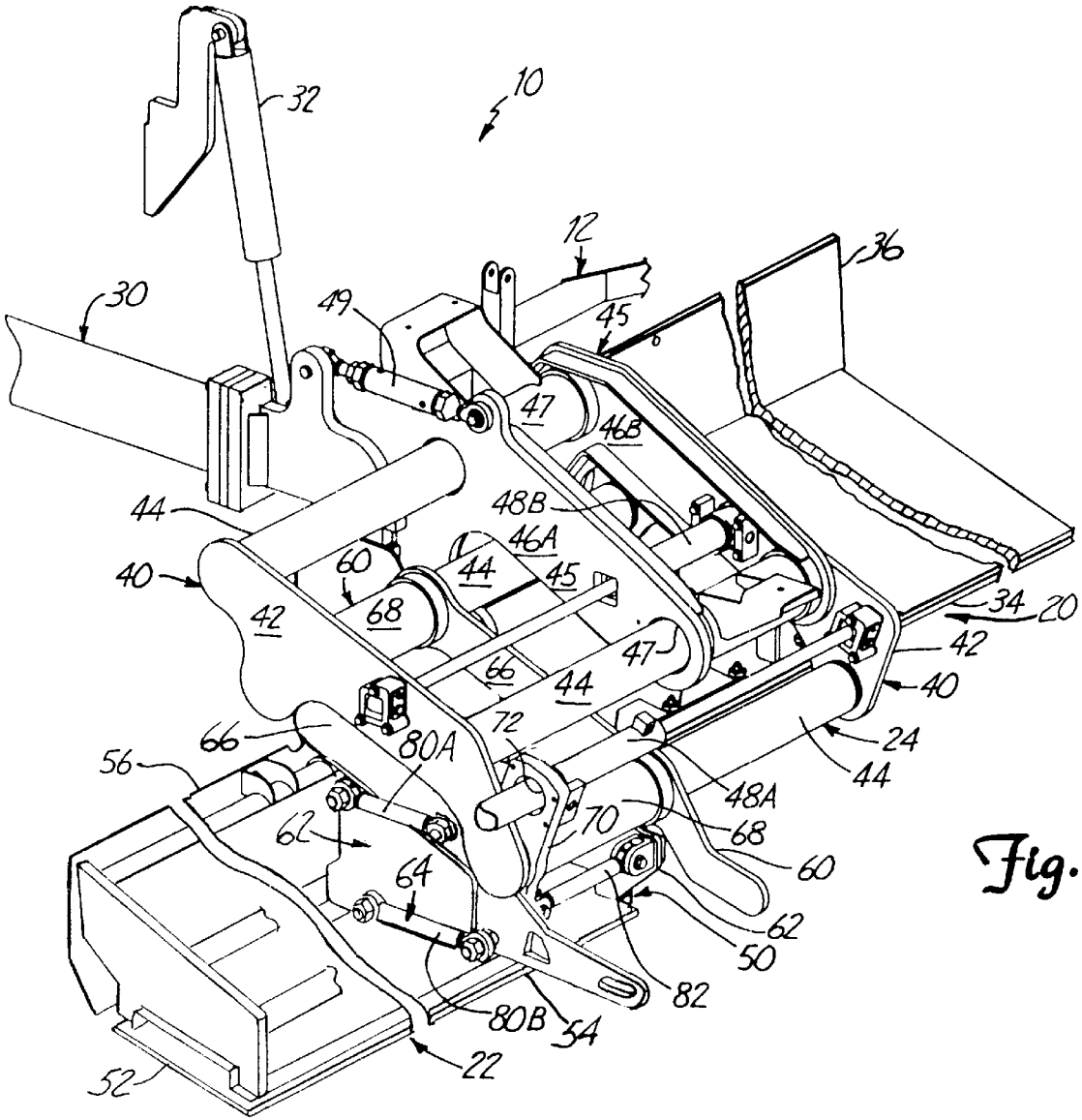
FIG. 1 is a perspective view of an asphalt paving screed incorporating a linkage mechanism and extender screed of the present invention.

A screed assembly 10 of the present invention is illustrated generally in FIG. 1 and includes a main screed 20, an extender screed 22 and a carriage mechanism 24. While only a single extender screed 22 is shown in FIG. 1 relative to main screed 20 for convenience in illustration, a pair of extender screeds typically would be deployed symmetrically relative to main screed 20.

As shown in FIG. 1, screed assembly 10 extends from a tractor (not shown) or paving vehicle frame via tow bars 30 and height adjusting piston 32. Main screed 20 includes screed plate 34 and front plate 36. Carriage mechanism 24 includes carriage 40 including side plates 42 with lateral tubes 44 extending therebetween, and carriage guide 45 which extends from a portion of main frame 12. Carriage guide 45 includes side plates 46A, 46B and tubes 47 through which carriage bars 44 extend and slidably move through. Carriage mechanism 24 also includes guide pistons 48A, 48B with guide piston 48B facilitating sliding movement of carriage 40 relative to carriage guide 45. Length-adjustable link 49 facilitates selective adjustment of the rotation of main screed 20, carriage mechanism 24, and extender screed 22 relative to tow bar 30. Link 49 preferably comprises a cylinder, ball screw or other length adjustable link known in the art.

Extender screed 22 includes inboard end 50 and outboard end 52, sole plate 54, and front plate 56. Extender screed 22 further includes upper frame 60, lower frame 62 and linkage mechanism 64 connecting upper frame 60 and lower frame 62. Upper frame 60 includes side plates 66 with lateral tubes 68 extending therebetween and vertical plate 70 with hole 72 for slidably receiving guide piston 48A of carriage mechanism 24.

Carriage 40 including tubes 44 is slidably movable laterally outward relative to main screed 20 since tubes 44 of carriage 40 slide through tubes 47 of stationary carriage guide 45. As shown in FIG. 1, this arrangement permits carriage 40 to slide laterally outward away from the main screed 20 from a storage position (or narrow paving position, or travel position) out to the illustrated in-use position, thereby permitting extender screed 22 to extend laterally outward from main screed 20. Guide pistons 48A and 48B selectively extend (FIG. 1) and retract (FIG. 2) to selectively cause carriage 40 to slide relative to carriage guide 45 to control the above described lateral motion.

In addition, upper frame 60 of extender screed 22 is slidably movable relative to carriage 40 since upper frame tubes 68 can slide over carriage tubes 44. This arrangement permits extender screed 22 to be selectively slidably moved laterally outward away from carriage 40, causing extender screed 22 to extend further laterally outward from main screed 20. Guide piston 48A selectively extends (FIG. 1) and retracts to selectively cause upper frame 62 of extender screed 22 to slide relative to carriage 40 to control the above described lateral sliding motion.

Although not shown in FIG. 1, a corresponding similarly arranged carriage mechanism 24 is deployed on the other nonillustrated side of main screed 20 to support a symmetrically paired extender screed 22.

As shown in FIG. 1, extender screed 22 is supported under upper frame 60 and carriage mechanism 24 by a linkage mechanism 64 interposed between upper frame 60 and lower frame 62 of extender screed 22. While only links 80A, 80B, and 82 can be seen in FIG. 1, linkage mechanism 64 includes three fore/aft elongate links 80A, 80B, and 80C, lateral link 82, and vertical links 84A, 84B (later shown in FIG. 2). Linkage mechanism 64 maintains extender screed sole plate 54 in close proximity to, and in selected vertical position relative to sole plate 34 of main screed 20 and maintains extender screed front plate 56 in close proximity to, and just lateral to main screed 20. Linkage mechanism 64, in combination with upper frame 60 and lower frame 62, is particularly adapted to minimize deflection between extender screed 22 and main screed 20 when extender screed 22 is deployed while paving asphalt.

Figure 2:
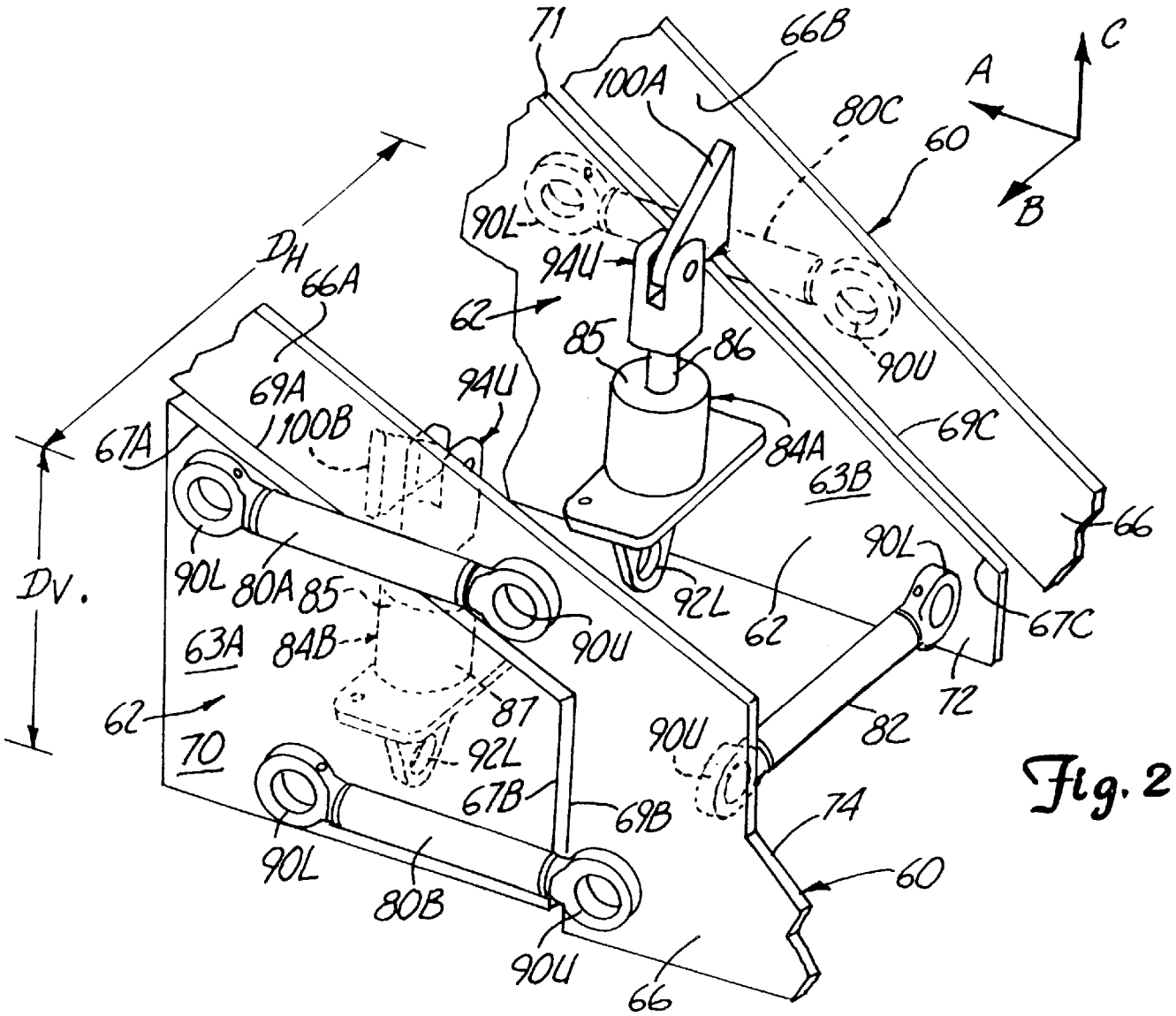
FIG. 2 is a perspective view of a linkage mechanism of the present invention shown in isolation from the remainder of the extender screed.

FIG. 2 shows linkage mechanism 64 as connected between upper frame 60 and lower frame 62 in isolation from the remainder of extender screed 22. Linkage mechanism 64 is arranged to control movement of lower frame 62 relative to upper frame 60 along three perpendicular axes generally parallel to first horizontal fore/aft axis A, second horizontal lateral axis B, and third vertical axis C.

Fore/aft links 80A, 80B and 80C extend between lower frame 62 and upper frame 60 along fore/aft axes generally parallel to horizontal axis A and thereby substantially limit movement of extender screed 22 relative to main screed 20 along a fore/aft axis generally parallel to horizontal fore/aft axis A. These three fore/aft links 80A, 80B, 80C substantially prevent movement of extender screed 22 relative to main screed 20 along a direction of travel of the paving vehicle. Fore/aft links 80A, 80B, and 80C have a fixed length which is preferably substantially the same for each fore/aft link.

Lateral link 82 extends between lower frame 62 and upper frame 60 along a lateral axis generally parallel to second horizontal lateral axis B and thereby substantially limits movement of the extender screed 22 relative to main screed 20 along a lateral axis generally parallel to lateral axis B. Lateral link 82 also has a fixed length.

Fore/aft links 80A, 80B, and 80C include spherical bearings mounted within lower frame mounting apertures 90L and upper frame mounting apertures 90U wherein lower frame mount 90L of links 80A, 80B, 80C is rotatably secured to a mounting end 110 on lower frame 62 and upper frame mounts 90U of links 80A, 80B, 80C are rotatably secured to a mounting pin 104 on upper frame 60. Similarly, lateral link 82 has spherical bearings mounted within its upper frame and lower frame mounting apertures 90U and 90L for rotatable mounting relative to upper frame 60 and lower frame 62.

Although the ends of fore/aft links 80A, 80B and 80C as well as lateral link 82 include rotatable connections, unconstrained translational and rotational movement of upper frame 60 relative to lower frame 62 is substantially limited to a selected level by predetermining a minimum length of the respective links 80A, 80B, 80C and 82. In particular, the length of the link is selected to substantially limit translational and rotational movement of upper frame 60 relative to lower frame 62 along and about axes generally parallel to the three generally perpendicular axes A, B, C. However, the selected link length can be selected to permit a predetermined amount of vertical movement of upper frame 60 relative to lower frame 62 (e.g. approximately 50 millimeters).

Vertical links 84A, 84B extend between upper frame 60 and lower frame 62 along an axis generally parallel to vertical axis C. Each link 84A, 84B has a cylinder 85 and an extendible/retractable rod 86 to permit selective adjustment of the length of links 84A, 84B. Vertical links 84A and 84B control vertical movement of upper frame 60 relative to lower frame 62 and are preferably a pair of vertical screw jacks known in the art. However, other actuators known in the art that permit selective adjustment of the length of the link can be used. Although vertical screw jacks can be configured for electronic or hydraulic control to select their length, the preferred embodiment includes a mechanical adjustment to select the length of the vertical link. The ends of vertical links 84A are also rotatably connected respectively to the upper frame 60 and lower frame 62 by spherical joints at each end. In particular, upper fork connectors 94U of vertical links 84A and 84B is rotatably connected via a spherical bearing to vertical link upper frame mounting plates 100A and 100B, respectively. Lower end mounting aperture 92L of vertical links 84A and 84B are rotatably connected via a spherical bearing to lower frame mounting plates (not shown). Finally, vertical links 84A, 84B are located approximately midway between a front edge and a back edge of sole plate 54 of extender screed 22.

The arrangement of links 80A, 80B, 80C, 82 and 84A, 84B is further defined by the shape and position of upper frame 60 relative to lower frame 62. Lower frame 62 includes side plate 63A with angled upper edge 67A and vertical edge 67B and side plate 63B with angled upper edge 67C. Plate 66A of upper frame 60 includes angled upper edge 69A and vertical edge 69B while plate 66B of upper frame 60 includes angled edge 69C. The relative position, shape and dimensions of upper angled edge 67A and vertical edge 67B of lower frame plate 63A reciprocates the relative position, shape and dimensions of upper edge 69A and vertical edge 69B of plate 66A of upper frame 60. Edge 69A of upper frame plate 66B extends generally parallel to edge 67C of lower frame plate 63B.

Links 80A and 80B extend along an outer surface 70 of lower frame plate 63A while link 80C extends along an outer surface 71 of lower frame plate 63B. Link 82 extends between an inner surface 72 of lower frame side plate 63B and inner surface 74 of upper frame side plate 66A. Vertical link 84A extends along inner surface 72 of lower frame plate 63B while vertical link 84B extends along inner surface 75 of lower frame plate 63A.

Figure 3:
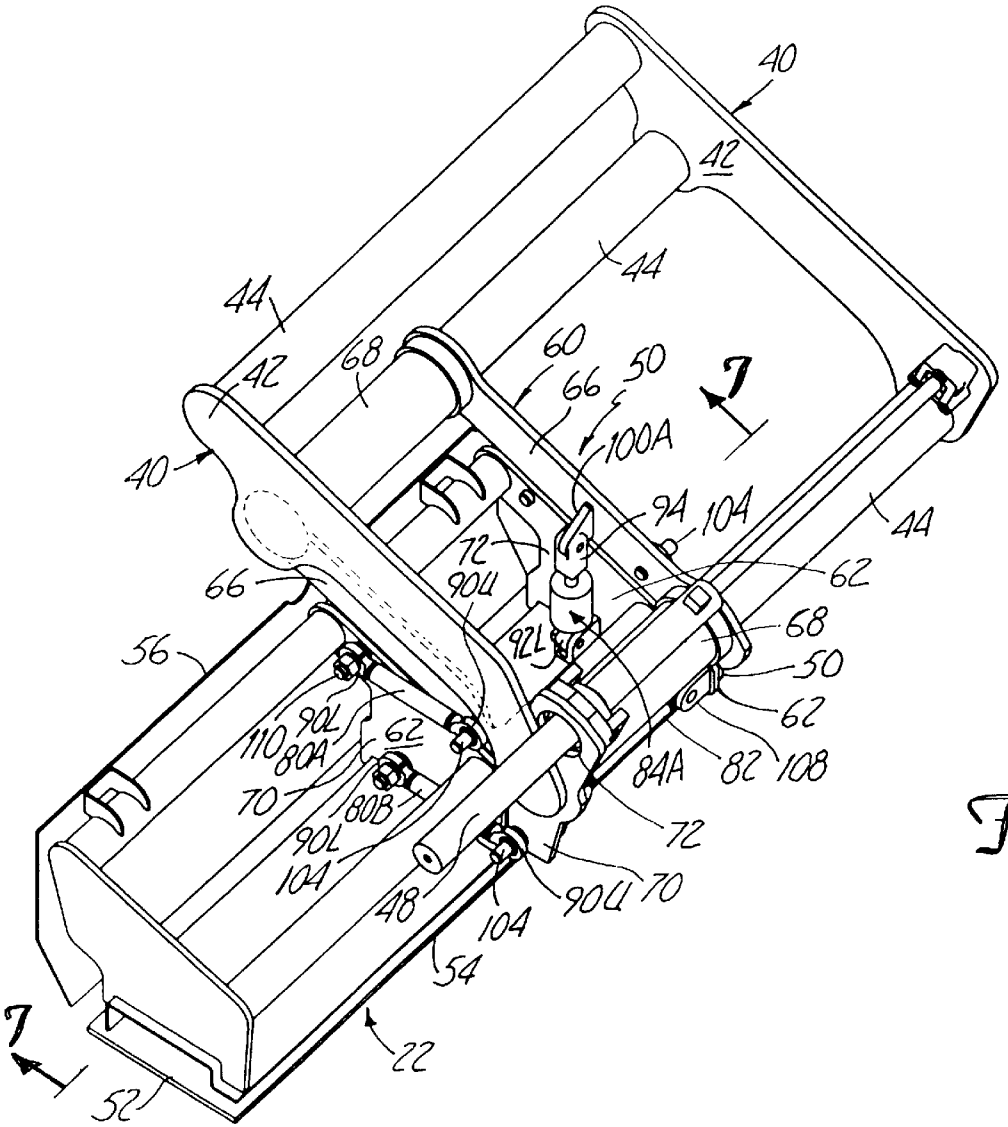
FIG. 3 is an enlarged perspective view of an extender screed and portions of a linkage mechanism of the present invention.
Figure 4:
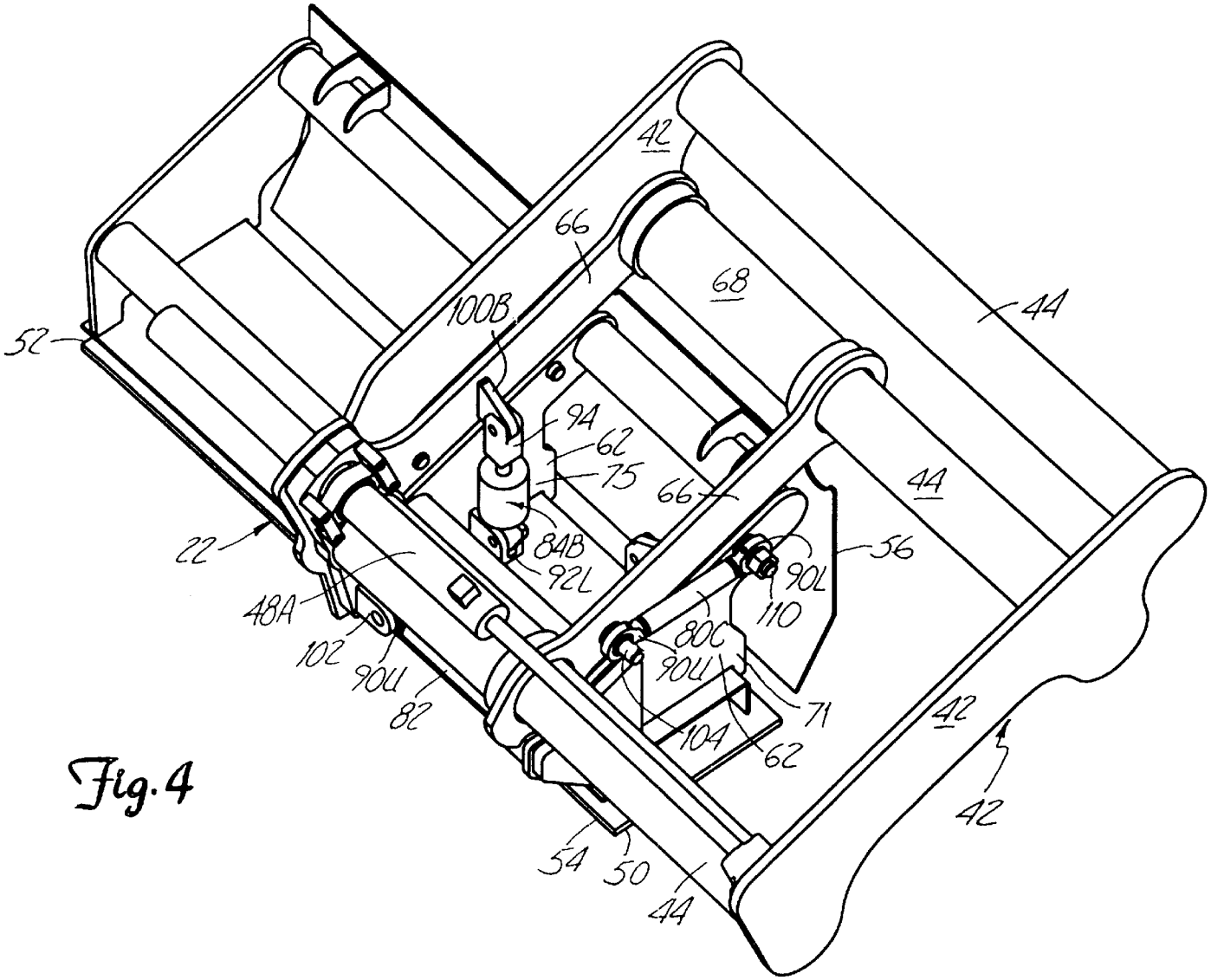
FIG. 4 is an enlarged perspective view of an extender screed and portions of a linkage mechanism of the present invention.

FIGS. 3 and 4 further illustrate linkage mechanism 64, lower frame 62 and upper frame 60 in context with remainder of lower frame 62, upper frame 60, extender screed 22, and carriage 40. As further shown in FIG. 3, lower frame mounting plate 108 secures an end of lateral link 82 to lower frame plate 63A while FIG. 4 further shows upper frame mounting plate 102 that secures the other end of lateral link 82 to upper frame plate 66A.

Figures 5, 6:
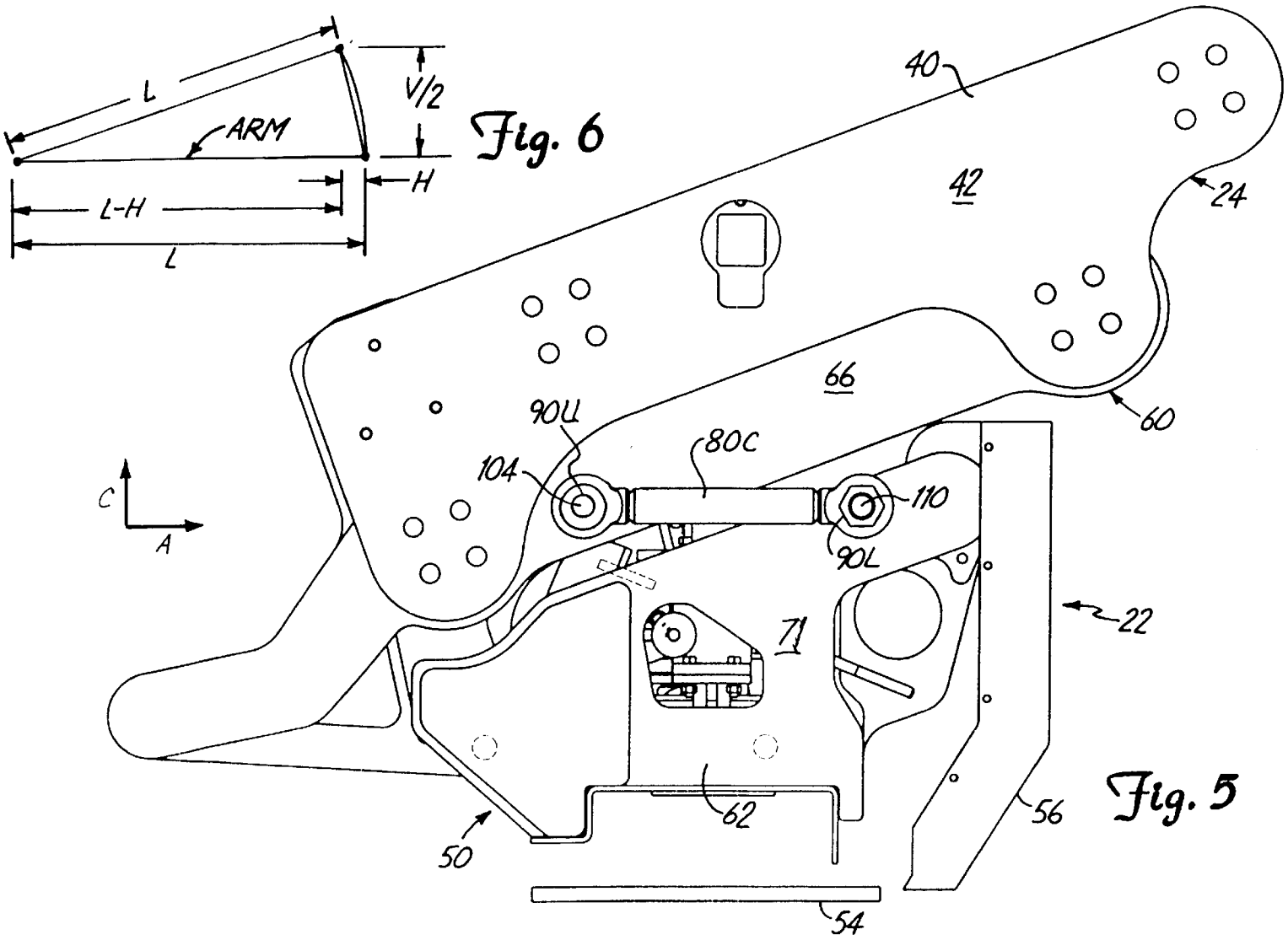
FIG. 5 is a side plan view illustrating a fore/aft link of the linkage mechanism of the present invention.
FIG. 6 is a schematic diagram of a mechanical model of a link of the linkage mechanism of the present invention.

FIG. 5 is a plan end view of inboard end 50 of extender screed 22 highlighting fore/aft link 80C and FIG. 6 is a schematic diagram illustrating a mechanical model of anyone of links 80A, 80B, 80C, and 82. As shown in FIG. 5, fore/aft link 80C extends between upper frame 60 and lower frame 62 to substantially limit movement of extender screed 22 relative to main screed 20 (via their interconnection through carriage mechanism 24). The length of link 80C (as well as links 80A, 80B, and 82) is selected according to a model of a swinging arm shown in FIG. 6, in which L represents a length of the arm, H represents the predetermined maximum desired horizontal movement between upper frame 60 and lower frame 62, and V represents the predetermined maximum permissible vertical movement between upper frame 60 and lower frame 62. Using this relationship with the swinging arm model, a link length of links 80C (and 80A, 80B, 82) is selected to limit translational movement of upper frame 60 relative to lower frame 62 to a negligible distance along axes generally parallel to horizontal fore/aft axis A (i.e. the maximum permissible horizontal movement, H) and generally parallel to horizontal lateral axis B. Rotational movement about the three axes is controlled by the vertical and lateral spacing of the links in a three dimensional relationship as shown in FIG. 2.

Figure 7:
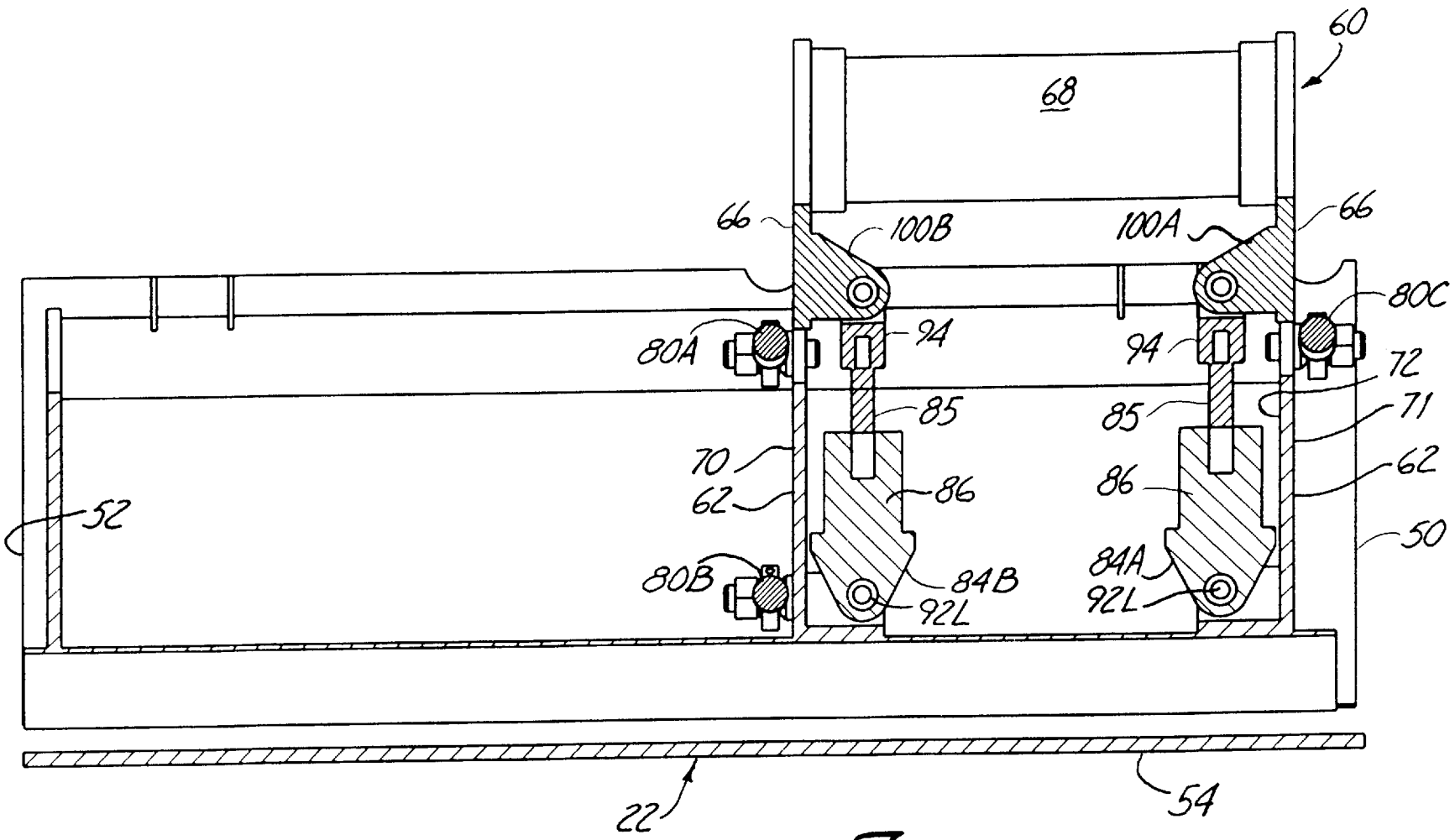
FIG. 7 is a sectional view illustrating a pair of length adjustable links of the linkage mechanism and extender screed of the present invention.
Figure 8:
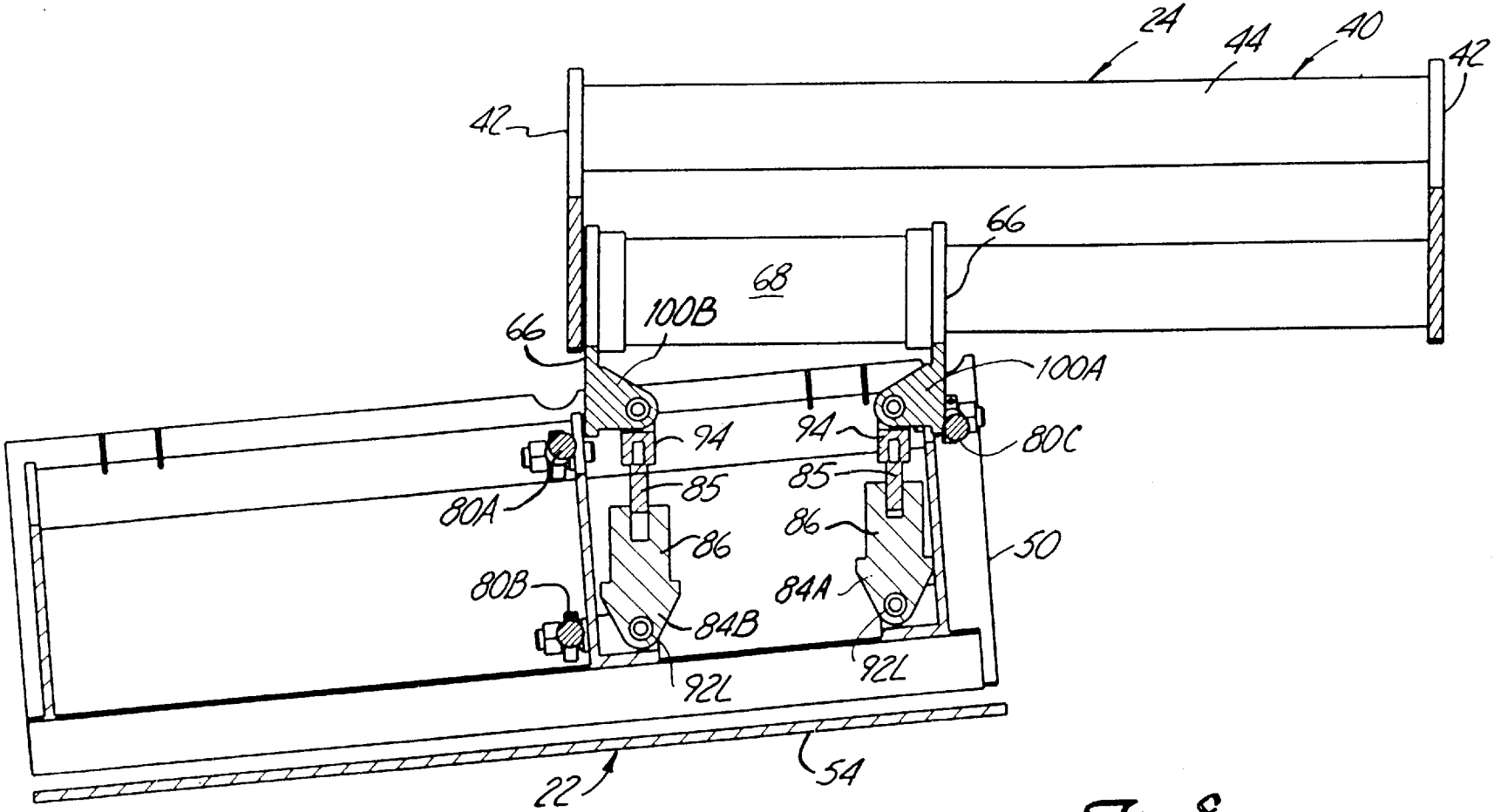
FIG. 8 is a sectional view illustrating a pair of length adjustable links of the linkage mechanism and extender screed of the present invention in a sloped position relative to a carriage mechanism of the present invention.

FIG. 7 is a cross sectional view of extender screed 22 highlighting vertical links 84A, 84B. Vertical links 84A and 84B are independently adjustable so that a relative upward or downward adjustment of the length of one of the links 84A, 84B can be made without adjusting the length of the other vertical link. For example, as shown in FIG. 8, selectively increasing the length of link 84B while maintaining (or even shortening) link 84A will cause lower frame 62 to slope (i.e. rotate) relative to upper frame 60 about an axis generally parallel to fore/aft axis A. This change in position, of course, causes sole plate 54 of extender screed 22 to slope relative to sole plate 34 of main screed 20 for creating an angled road surface under the extender screed 22. Accordingly, maintaining a length of inboard vertical link 84A while lengthening vertical link 84B will cause sole plate 74 to slope to create a crown to the paved road surface while an opposite manipulation of shortening inboard vertical link 84A and maintaining a length of outboard link 84B will cause a road surface to angle inwardly to create a trough.

Of course, both vertical links 84A and 84B can be selectively shortened or lengthened together to raise or lower the surface sole plate 74 of extender screed 22 relative to sole plate 34 of main screed 20 without sloping extender screed 22 relative to main screed 20.

In addition, while fore/aft links 80A, 80B, 80C, lateral link 82, and vertical links 84A, 84B substantially limit movement along three generally perpendicular axes A, B, and C, each link 80A, 80B, 80C, 82 can rotate independently from each other within their limits constrained by the length of the links (and the relative vertical and lateral spaced position of the links in a three dimensional relationship). In combination, the six links of linkage mechanism 64 operate to control movement of lower frame 60 relative to upper frame 62 (and thereby movement of extender screed 22 relative to main screed 20) in six degrees of freedom (3 translational, 3 rotational) while also permitting selective adjustment of vertical spacing and sloping of extender screed 22 relative to main screed 20 to selectively shape the asphalt paved road surface.

This unique arrangement of linkage mechanism 64 which connects and maintains upper frame 60 in a vertically spaced relationship relative to lower frame 62 minimizes the number and size of connecting frame parts required to support extender screed 22 relative to main screed 20 (via their interconnection by carriage mechanism 24). In turn, by minimizing the length of frame parts required to support extender screed 22, the frame of extender screed 22 as well as the supporting upper frame 60 can be made of a heavier proportion of materials thereby increasing the stiffness of the extender screed 22 for a given total amount of material used to construct the extender screed. This improved ratio of stiffness to weight in the framing of extender screed 22, and its connection to main screed 20, minimizes deflection of extender screed 22 relative to main screed 20 while under load.

Finally, a linkage mechanism 64 of the present invention can be modified slightly and still optimally control movement of lower frame 60 relative to upper frame 62. For example, the three fore/aft links 80A, 80B, 80C, can be arranged in different configurations provided that at least two of the links are laterally spaced apart (each extending along an axis generally parallel to lateral axis B) and that at least two of the links are vertically spaced apart (each extending along an axis generally parallel to vertical axis C). The key relationship to maintain is substantially limiting translational and rotational movement between upper frame 60 and lower frame 62 along the three generally perpendicular axes within predetermined parameters while permitting (via links 84A, 84B) selective adjustment of the degree of slope about a horizontal fore/aft axis and selective adjustment of vertical spacing along a vertical axis, thereby permitting selective vertical adjustment and sloping of extender screed 22 relative to main screed 20.

The relatively close lateral spacing of vertical links 84A, 84B enables the slope of extender screed 22 to be adjusted quickly since this close lateral spacing causes a greater slope change for a given length adjustment of one of links 84A, 849 than if the links 84A, 84B (other length adjustable links) were spaced further apart as in prior art screeds where the vertical actuators are located at opposite ends of the extender screed. This sloping adjustment is also quicker than a height adjustment which requires adjusting both links together. This quick slope adjustment is important in paving applications since a change in the slope of the pavement needs to made quickly whereas changes in the height adjustment are typically made slowly. The quick slope change feature is particularly important in North America where the general paving speed tends to be relatively fast.

These advantages are achieved in part by the relative dimensions and spacing of the linkage mechanism as well as the dimensions and position of the linkage mechanism 64 relative to the dimensions and shape of the extender screed 22. For example, linkage mechanism 64, upper frame 60, and lower frame 62 has a width (approximately equal to the lateral spacing ($D_H$ in FIG. 2) between vertical links 84A, 84B) that is about one-third the width of the entire extender screed 22. Moreover, the height of linkage mechanism 64 (approximately equal to the vertical spacing ($D_V$ in FIG. 2) between links 80A and 80B) is about one-third the width of linkage mechanism. Restricting the width of linkage mechanism 64, upper frame 60, and lower frame 62 relative to the entire width of extender screed facilitates the quick sloping feature of the present invention and minimizes deflection of extender screed 22 relative to main screed 20.

Figure 9:
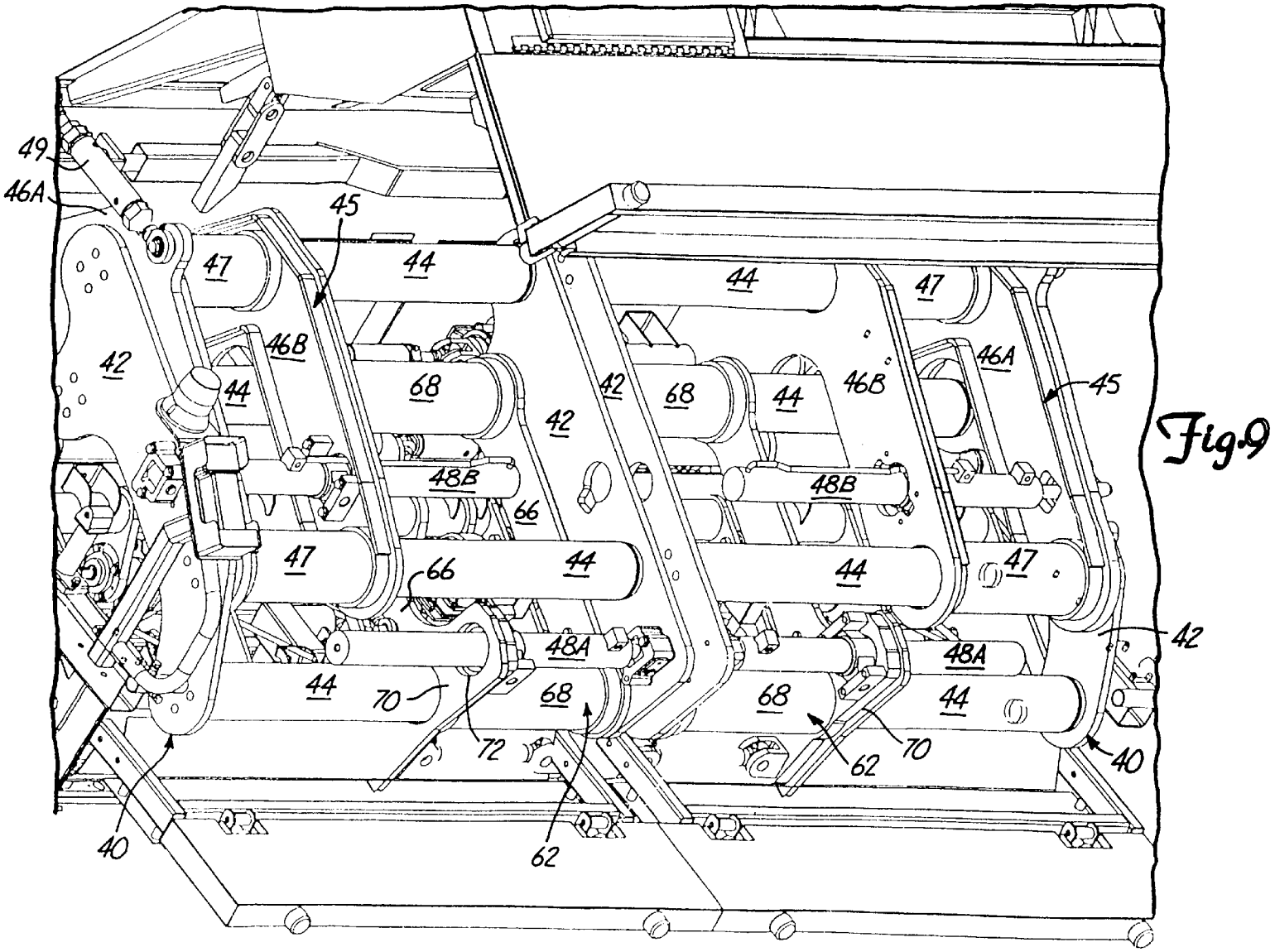
FIG. 9 is a perspective view of a pair of carriage mechanisms of the present invention.

Finally, FIG. 9 illustrates a pair of carriage mechanisms 24 (see FIG. 1) in a retracted position (for storage, travel, or a narrow paving path) in which each carriage 40 is retracted relative to carriage guide 45 (to be positioned laterally inward toward a center line of main screed 20) and in which upper frame 62 of extender screed 22 is shown in a retracted position (i.e. positioned laterally inward toward a center line of main screed 20) relative to carriage 40. This arrangement is achieved by actuating guide pistons 48A, 48B to their retracted positions (from their extended positions shown in FIG.1) thereby causing the corresponding retraction of carriage 40 and extender screed upper frame 62. This relationship places each extender screed 22 immediately behind main screed 20 to permit normal road travel of the asphalt paver and screed assembly 10 (or to permit a narrow paving path or storage). As shown, the pair of carriage mechanisms 24 are symmetrically balanced in their retracted position. This symmetry is also maintained in the extended position shown in FIG. 1. Symmetrical extension of carriages 40 permits extender screeds 22 to have identical deflection and travel characteristics relative to main screed 20, thereby permitting the weight, spacing, and structural design of each extender screed 22 to be symmetrically identical.

Although the present invention has been described with reference to preferred embodiments, workers skilled in the art will recognize that changes may be made in form and detail without departing from the spirit and scope of the present invention.

I claim:

1. An asphalt paver screed comprising:

a main screed;

at least one extender screed having an upper frame and a lower frame, the upper frame connected to and being slidably movable relative to the main screed to permit the at least one extender screed to extend laterally outward relative to the main screed along an axis generally parallel to a first horizontal axis, and the at least one extender screed having a linkage mechanism connecting the upper frame to the lower frame to maintain the upper frame in a vertically spaced relationship relative to the lower frame, the linkage mechanism comprising:

a plurality of elongate links with each link having its ends connected to the upper frame and the lower frame and arranged to control movement of the lower frame relative to the upper frame along three generally perpendicular axes, the plurality of links including:

at least one elongate link extending along, and substantially limiting movement of the lower frame relative to the upper frame along, a lateral axis generally parallel to the first horizontal axis;

at least one elongate link extending along, and substantially limiting movement of the lower frame relative to the upper frame along, a fore/aft axis generally parallel to the second horizontal axis; and at least one selectively length-adjustable link extending along, and substantially limiting movement of the lower frame relative to the upper frame along, an axis generally parallel to a third vertical axis.

2. The asphalt paver screed of claim 1 wherein at least one elongate link extending along the lateral axis has a first end rotatably mounted to the upper frame and a second end rotatably mounted to the lower frame;

at least one elongate link extending along the fore/aft axis has a first end rotatably mounted to the upper frame and a second end rotatably mounted to the lower frame; and at least one selectively length-adjustable link has a first end rotatably mounted to the upper frame and a second end rotatably mounted to the lower frame.

3. The asphalt paver screed of claim 2 wherein the at least one elongate link extending along the fore/aft axis comprises three elongate fore/aft links wherein a first link and a second link of the three fore/aft links are spaced laterally from a third link of the three fore/aft links along an axis generally parallel to the first horizontal axis, and the first link is spaced vertically from the second link along an axis generally parallel to the third vertical axis.

4. The asphalt paver screed of claim 1 wherein the at least one length-adjustable link comprises two length-adjustable links, with each link having a first end rotatably connected to the upper frame and a second end rotatably connected to the lower frame, the two links being spaced apart laterally along an axis generally parallel to the first horizontal axis wherein the lateral spacing is substantially less than a width of the extender screed.

5. The asphalt paver screed of claim 4 wherein a length of each length-adjustable link is controllable independently.

6. An asphalt paver screed comprising:

a main screed;

at least one extender screed having an upper frame and a lower frame, the upper frame connected to and being slidably movable relative to the main screed to permit the at least one extender screed to extend laterally outward relative to the main screed along an axis generally parallel to a first horizontal axis, and the at least one extender screed having a linkage mechanism connecting the upper frame to the lower frame to maintain the upper frame in a vertically spaced relationship relative to the lower frame, the linkage mechanism comprising:

a plurality of elongate links with each link extending between and connected to the upper frame and the lower frame and arranged along three generally perpendicular axes, the plurality of links including:

one elongate link extending along a lateral axis generally parallel to the first horizontal axis;

three elongate links extending along a fore/aft axis generally parallel to the second horizontal axis; and two selectively length-adjustable links extending along an axis generally parallel to a third vertical axis.

7. An asphalt paver screed comprising:

a main screed;

an extender screed;

a linkage mechanism interposed between the extender screed and the main screed and including a linking frame connected to and extending rearwardly from the main screed to permit the extender screed to selectively extend laterally outward relative to the main screed and further including a supporting linkage comprising:

at least one elongate link having a first end rotatably connected to the extender screed and a second end rotatably connected to the linking frame, the link extending along, and substantially limiting movement of the extender screed relative to the main screed along, a lateral axis generally parallel to a first horizontal axis and generally perpendicular to a direction of travel of the asphalt paver screed along a second horizontal axis;

and at least one elongate link having a first end rotatably connected to the extender screed and a second end rotatably connected to the linking frame, the link extending along, and substantially limiting movement of the extender screed relative to the main screed along, a fore/aft axis generally parallel to the second horizontal axis; and at least one selectively length-adjustable link having a first end connected to the extender screed and a second end connected to the linking frame, the length-adjustable link extending along, and substantially limiting movement of the extender screed relative to the main screed along, an axis generally parallel to a third vertical axis perpendicular to both the first and second horizontal axis.

8. The asphalt paver screed of claim 7 wherein the first end of the at least length adjustable link is rotatably connected to the extender screed and the second end of the at least one length-adjustable link is rotatably connected to the linking frame.

* * * * *